US011690448B1

(12) United States Patent
Zimmerman et al.

(10) Patent No.: US 11,690,448 B1
(45) Date of Patent: Jul. 4, 2023

(54) STAND FOR SPORT BOARDS

(71) Applicants: Lior Zimmerman, Rishpon (IL); Amit Lavion, Beit Yehoshua (IL)

(72) Inventors: Lior Zimmerman, Rishpon (IL); Amit Lavion, Beit Yehoshua (IL)

( * ) Notice: Subject to any disclaimer, the term of this patent is extended or adjusted under 35 U.S.C. 154(b) by 0 days.

(21) Appl. No.: 17/864,635

(22) Filed: Jul. 14, 2022

(51) Int. Cl.
*A47B 81/00* (2006.01)
*B63C 15/00* (2006.01)

(52) U.S. Cl.
CPC ..... *A47B 81/00* (2013.01); *B63C 15/00* (2013.01)

(58) Field of Classification Search
CPC ..... A47B 81/00; A47B 81/005; B63C 15/00
See application file for complete search history.

(56) References Cited

U.S. PATENT DOCUMENTS 2,623,639 A * 12/1952 Levy ..... A47B 81/005 211/64
2,946,452 A * 7/1960 Caloiero ..... A47B 81/005 211/64
2,958,423 A * 11/1960 Caloiero ..... A47B 81/005 211/64
3,180,494 A * 4/1965 Levy ..... A47B 81/005 108/31
3,288,304 A * 11/1966 Graves ..... A47B 81/005 211/64
3,291,317 A * 12/1966 Bowen ..... F41A 23/18 248/220.21
3,840,282 A * 10/1974 Major ..... A47B 81/005 211/60.1
4,181,221 A * 1/1980 Tennant ..... A47B 81/005 211/195
4,352,480 A * 10/1982 Gathright ..... G10G 5/00 84/327
5,285,906 A * 2/1994 Wisnowski ..... A47B 81/00 211/70.5
5,454,931 A * 10/1995 Lauve, Jr. ..... F41A 23/18 312/265.5
5,833,079 A * 11/1998 Roberts ..... A47B 81/00 D6/552
6,296,213 B1 * 10/2001 Law, III ..... G10G 5/00 206/759
6,457,619 B1 * 10/2002 Werner ..... B60R 9/08 224/497
6,752,278 B2 * 6/2004 Craft ..... A47B 81/00 D6/552
7,721,900 B2 * 5/2010 Waterman ..... A47F 7/0028 211/89.01

(Continued)

*Primary Examiner* — Stanton L Krycinski

(57) ABSTRACT

A stand for sport boards that includes two foldable legs, an upper member with notches for supporting the boards, and a base that contains a drawer for storing the legs and the upper member. Each leg includes two parallel lower plates and an upper plate axially connected to the lower plates by a hinge so that the upper plate is positioned between the lower plates. The top parts of the lowers plates include a back grooves and the lower part of the upper plate has a matched back grooves, enabling to lock the leg in an open position by a piece that is inserted into the grooves. The bottom parts of the lower plates have L-shaped connectors that match L-shaped tunnels in the base. Top parts of the upper plates have front groves that match back groves in the back corners of the upper member.

3 Claims, 8 Drawing Sheets

(56) References Cited

U.S. PATENT DOCUMENTS

| | | | | |
|---|---|---|---|---|
| 8,002,126 | B1 * | 8/2011 | Drum | A47B 43/00 211/195 |
| 8,167,148 | B2 * | 5/2012 | Jacobson | G10G 5/00 108/193 |
| 8,479,928 | B2 * | 7/2013 | Tanabe | A63B 71/0045 211/186 |
| 9,370,277 | B2 * | 6/2016 | Weaver | A47J 47/16 |
| 10,072,791 | B2 * | 9/2018 | Beta | F16M 11/42 |
| 2006/0027514 | A1 * | 2/2006 | Carlson | A47B 81/005 211/72 |
| 2009/0039225 | A1 * | 2/2009 | Taylor | A63C 11/028 211/89.01 |
| 2010/0122960 | A1 * | 5/2010 | Bliss | A47B 43/00 211/64 |
| 2015/0306488 | A1 * | 10/2015 | Gouldthorpe | A63C 17/017 211/85.7 |

* cited by examiner

STAND FOR SPORT BOARDS

FIELD OF THE INVENTION

The present invention refers to a stand for sport boards.

BACKGROUND ART

Many people who have several sport boards, for surfing, skateboarding, snowboarding, windsurfing, sandboarding, and other kinds of sport activities that are performed mainly by a board on water, on pavement, on unpaved land, on snow, on sand, or in air for example. The term "sport boards" in the present disclosure and in the claims refer to all those kinds of boards that are used in these sport activities. In such cases, a stand is needed for placing the boards safely, stable and without using much space. The present invention discloses an innovative stand for sport boards that can be disassembled and assembled without the need of tools or screws, and that enable to store the parts of the stand in a drawer that is contained in the base of the stand. The stand is easily assembled and disassembled easily into a compact, portable package inside the base of the stand that serves as a box of its parts.

DESCRIPTION OF THE DRAWINGS

The intention of the drawings attached to the application is not to limit the scope of the invention and its application.

The drawings are intended only to illustrate the invention and they constitute only one of its many possible implementations.

THE INVENTION

Figure 1:
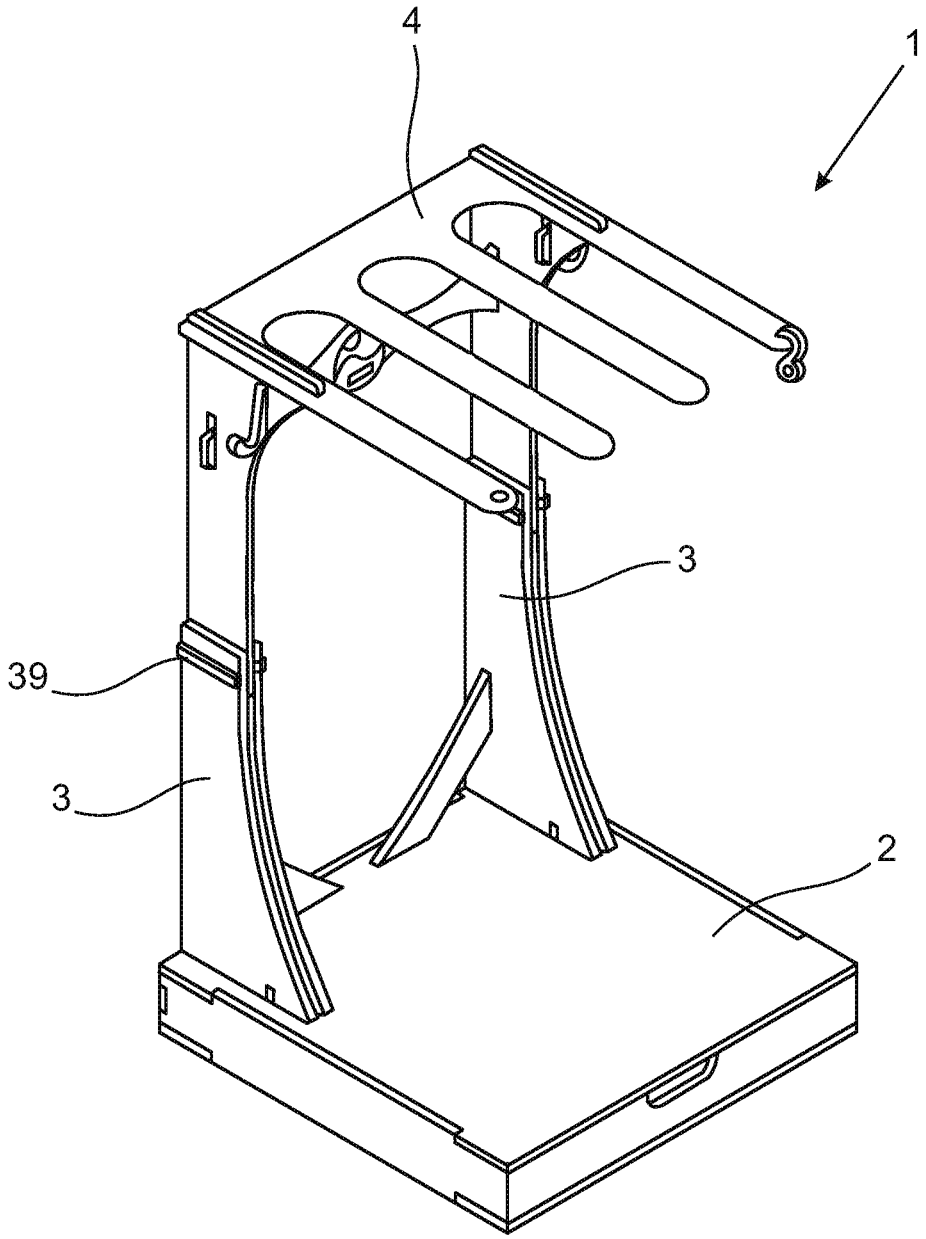
FIG. 1 depicts a perspective view of the stand (1).
Figure 2:
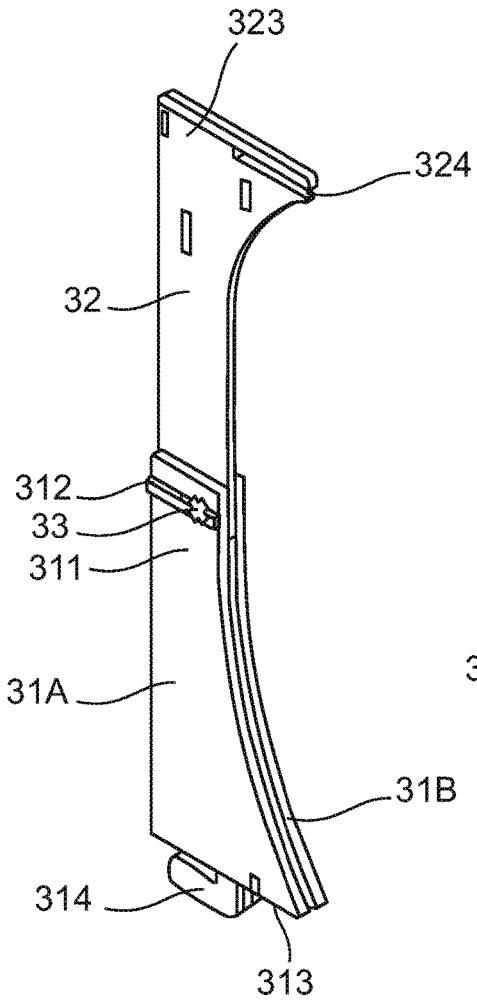
FIGS. 2-7 depict the two foldable legs (3) and their parts.
Figure 3:
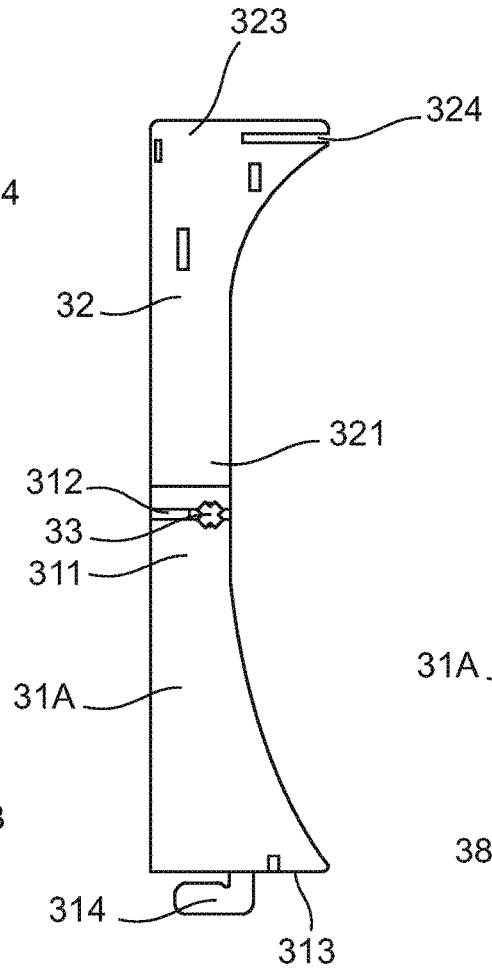
Figure 4:
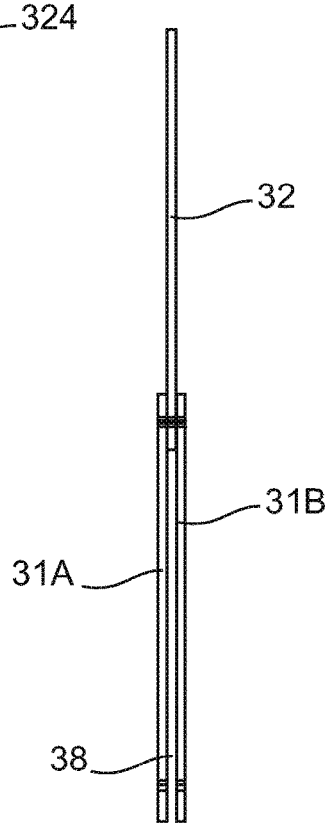
Figure 5:
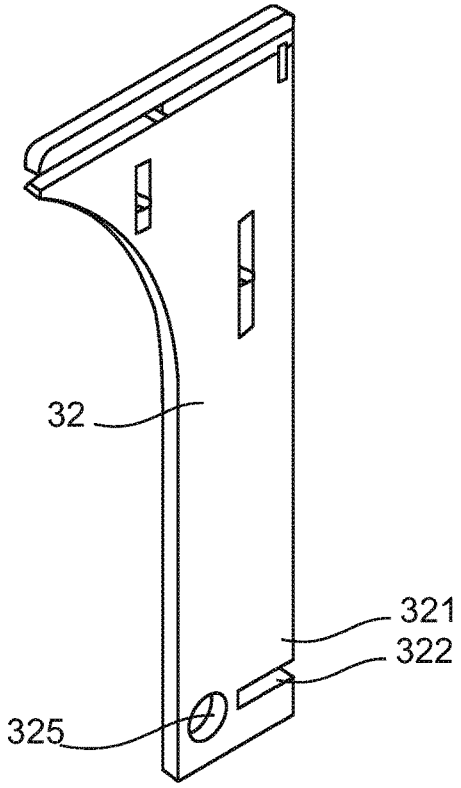
Figure 6:
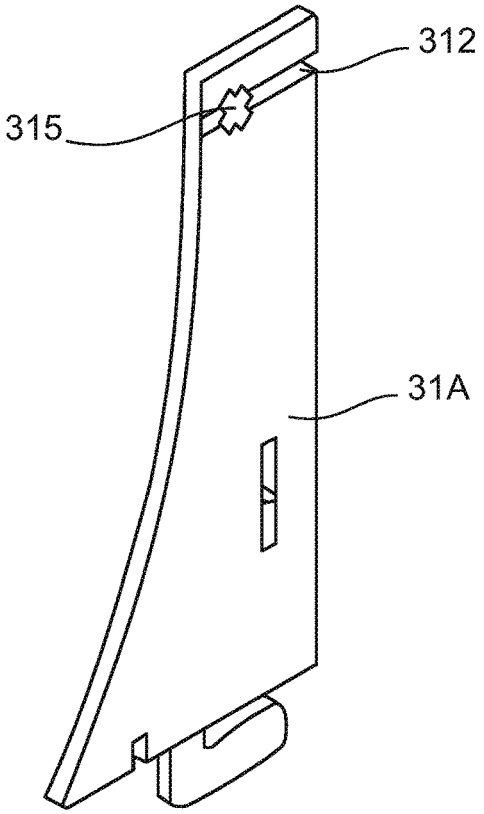
Figure 7:
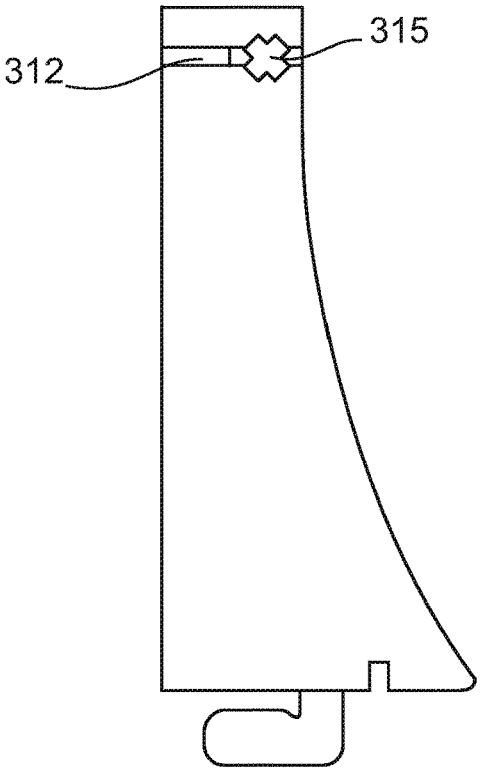

The objective of the present invention is to provide a stand (1) for at least three sport boards (100) that comprises a base (2), two foldable legs (3), and an upper member (4) that includes at least three notches (41) each of which is designed to receive and support a sport board. It is preferably to manufacture the parts of the stand from wood. The connection of the parts of the stand to each other is done with bare hands without the need for working tools. The stand can be disassembled and assembled by hand, without the need for special skill. The dimensions of the stand may and should fit standard sizes of sport hoards.

The base (2) is substantially in a shape of a rectangular box containing a drawer (23) that is designed to contain the two foldable legs and the upper member when the stand is disassembled for transporting or storing.

Each foldable leg comprises two parallel. lower plates (31A) (31B) and an upper plate (32). The upper plate is axially connected to the two lower parallel plates by a hinge (33) that passes through a pair of holes (315) in the bottom panels and a matching hole (325) in the upper plate, in such a way that the upper plate is partially positioned between the two parallel lower plates, The axial connection enables the upper plate to fold into in a gap (38) between the two parallel lower plates.

The top part (311) of the two parallel lower plates of each foldable leg includes a back groove (312), and the lower part (321) of the upper plate has a corresponding back groove (322) that matches the back grooves of the parallel lower plates, so that when each foldable leg is in an open position it can be locked by a piece (39) that can be inserted into the back grooves and the corresponding back groove to disable the foldable leg to fold. This piece can be a plate for example.

The bottom part (313) of the two parallel lower plates of each foldable leg has an L-shaped connector (314), and each back corner (21) of the base has a corresponding L-shaped tunnel (22) that matches the L-shaped connector. These L-shaped connectors enable to connect the two legs to the base by inserting them into the L-shaped tunnel (22) inside the base.

The top part (323) of each upper plate of each foldable leg has front groove (324), and each back corner (42) of the upper member (4) has a corresponding back groove (43) that matches the front groove. These corresponding back grooves enable to connect the upper member to the two legs by assembling them with the front grooves of the two foldable legs.

Figure 8:
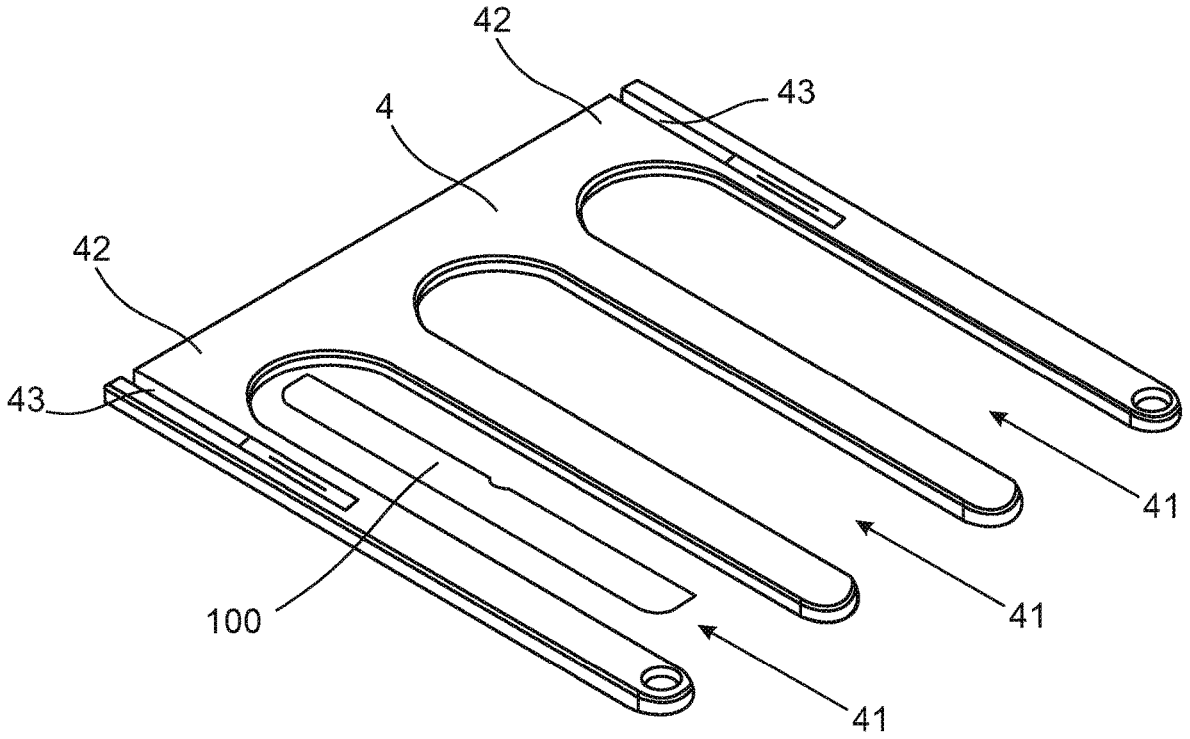
FIG. 8 depicts the upper member (4).
Figure 9:
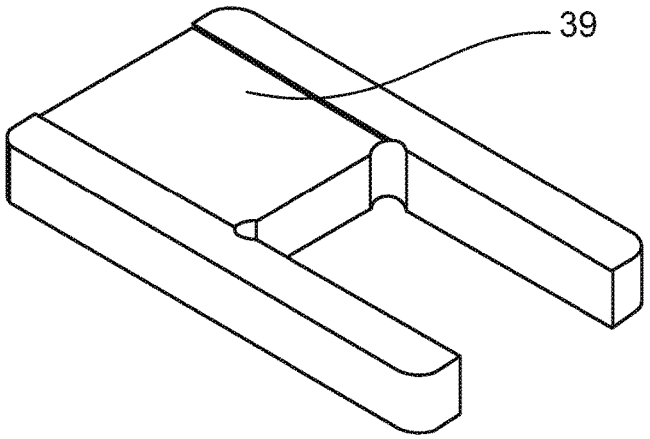
FIG. 9 depicts the piece (39).
Figure 10:
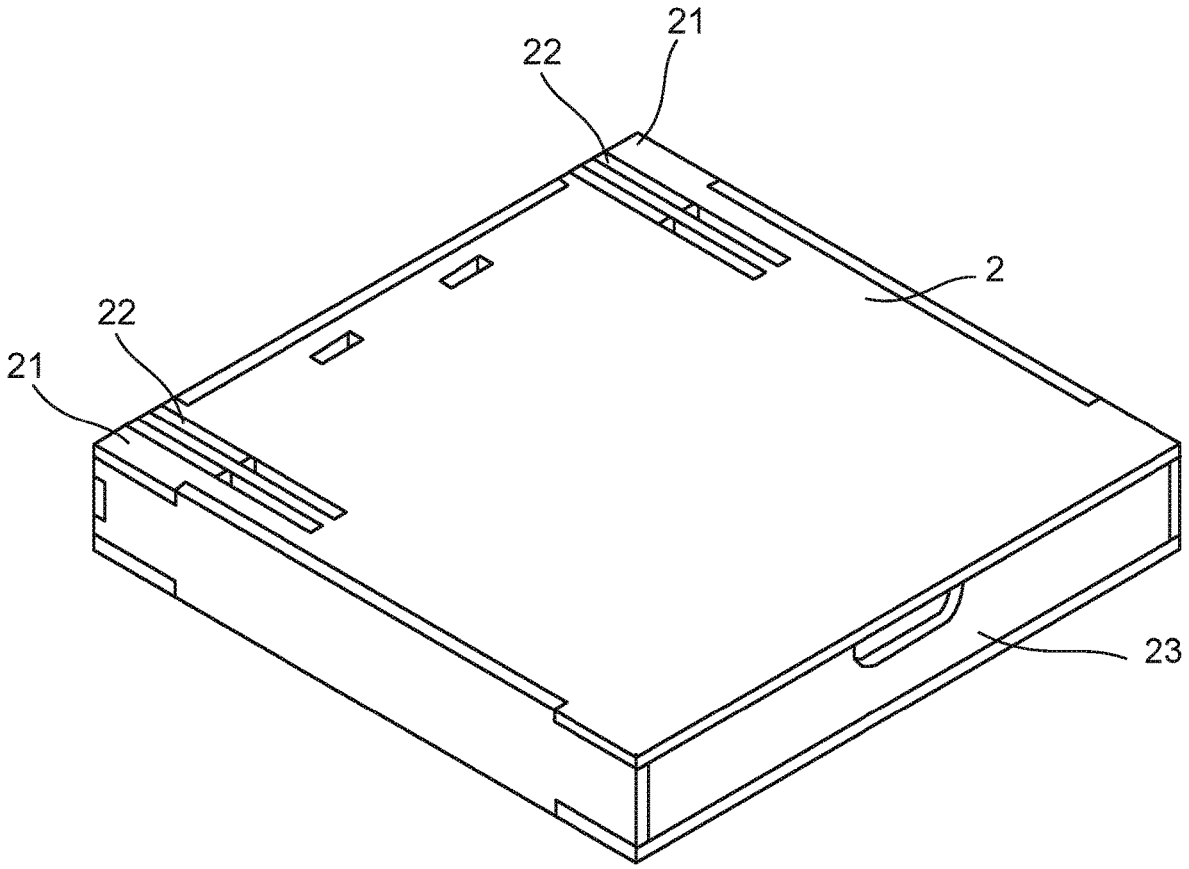
FIG. 10 depicts the base (2).

FIG. 1 depicts a perspective view of the stand (I), FIGS. 3-7 depict the two foldable legs (3) and their parts, FIG. 8 depicts the upper member (4) with schematic depiction of a sport board (100), FIG. 9 depicts the piece (39), and FIG. 10 depicts the base (2).

Figure 11:
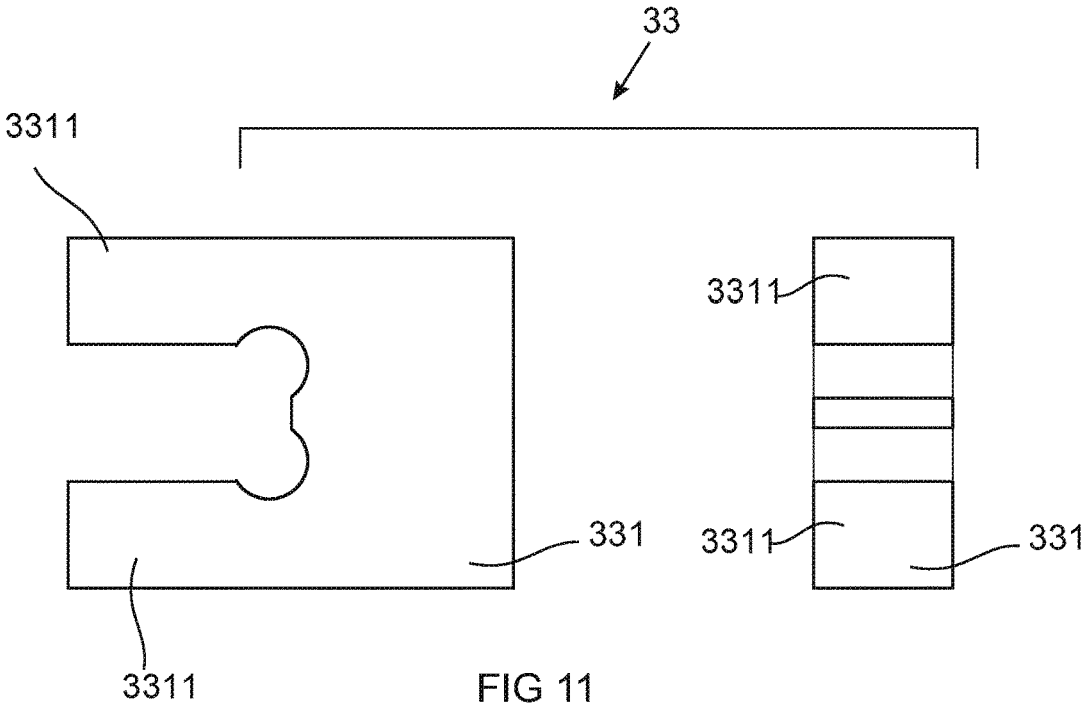
FIG. 11 depicts the two pieces (331)

The holes (315) in the parallel lower plates (31A) (31B) can be a cross-shaped holes and the hinge (33) can comprise two pieces (331) each of which has two parallel rods (3311). When combining together these two pieces (331) inside the cross-shaped holes (through the hole 325 in the upper plate) comprises the hinge (33) that enables the axial attachment of the parallel lower plates and the upper plate together without a. to need of nails or screws or any other instrument. FIG. 11 depicts these two pieces.

Figure 12:
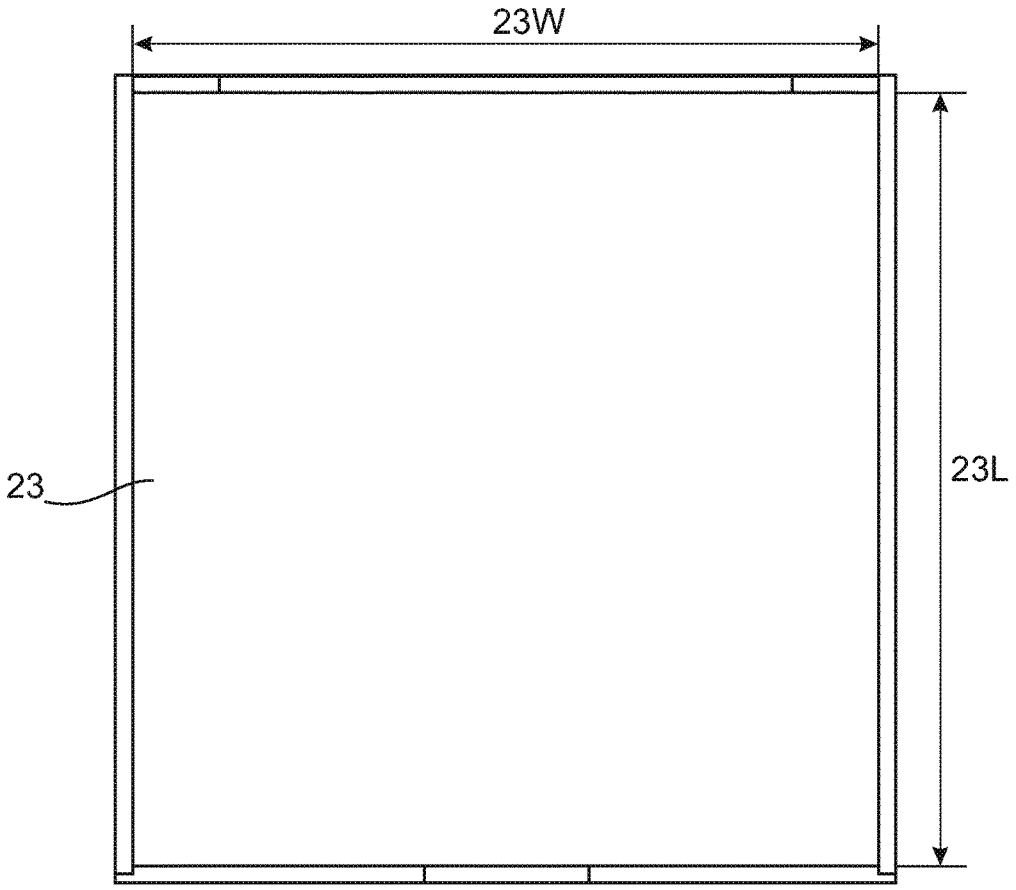
FIG. 12 depicts the drawer (23) and its dimensions.
Figure 13:
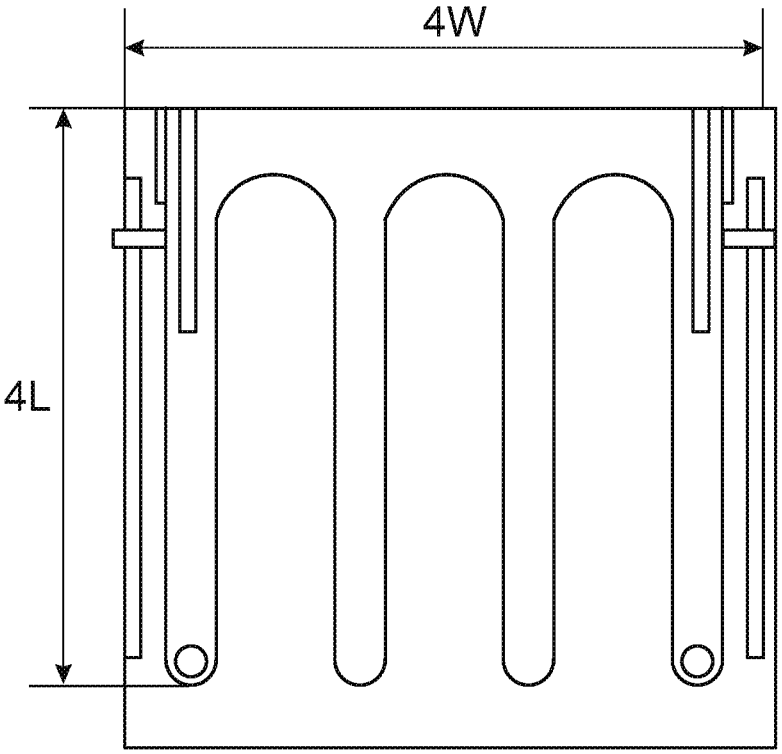
FIG. 13 depicts the upper member (4) and its dimensions.
Figure 14:
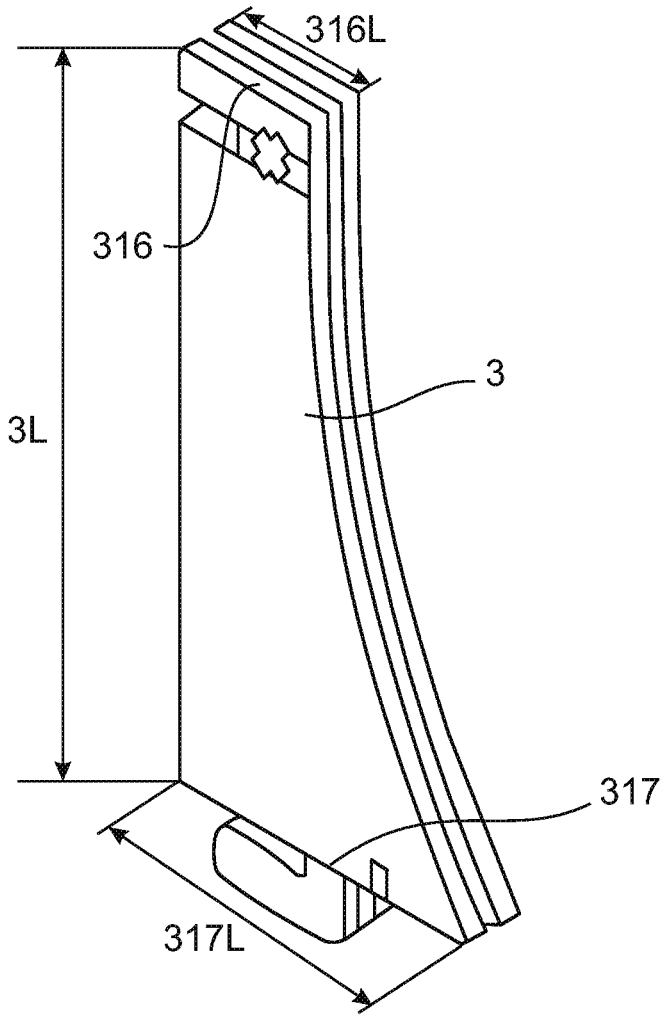
FIG. 14 depicts the foldable lea in a folded position and its dimensions.

In order to enable quick and efficient storage of the upper member and of the foldable legs inside the drawer, together with the other parts of the stand, it is highly desirable that the dimensions of said parts be in appropriate proportions. The stand inner length (23L) of the drawer (23) should be equal to or greater than the length (41,) of the upper member (4), and the inner width (23W) of the drawer is equal to or greater than the width (4W) of the upper member. Also, wherein the inner length (23L) of the drawer should be equal to or greater than the length (3L) of each foldable legs, and the inner width (23W) of the drawer is equal to or greater than the length (316L) of the upper side (31.6) of the foldable legs together with the length (317L) of the bottom side (317) of the legs, so that the foldable legs can be placed side by side, in the opposite direction, inside the drawer, so that they do not take up too much height, FIG. 12 depicts the drawer (23) and its dimensions, FIG. 13 depicts the upper member (4) and its dimensions, and FIG. 14 depicts the foldable leg in a folded position and its dimensions.

What is claimed is:

1. A stand for at least three sport hoards that comprises a base, two foldable legs, and an upper member that includes at least three notches each of which is designed to receive and support a sport board;

wherein the base is substantially in a shape of a rectangular box containing a drawer that is designed to contain said two foldable legs and said upper member when transporting or storing the stand;

wherein each foldable leg comprises two parallel lower plates and an upper plate, wherein the upper plate is axially connected to the two lower parallel plates by a hinge that passes through a pair of holes in bottom panels and a matching hole in the upper plate, in such a way that the upper plate is partially positioned between the two parallel lower plates; wherein the axial connection enables the upper plate to fold into in a gap between the two parallel lower plates;

wherein a top part of each parallel lower plate of each foldable leg includes a back groove, and a lower part of the upper plate of each foldable leg has a corresponding back groove that matches the back grooves of the two parallel lower plates, so that when each foldable leg is in an open position the foldable leg can be locked by a piece that can be inserted into the hack grooves and the corresponding back groove to disable the foldable leg to fold;

wherein a bottom part of the two parallel lower plates of each foldable leg has an L-shaped connector, and each back corner of the base has a corresponding L-shaped tunnel that matches the L-shaped connector, wherein the L-shaped connectors are designed to connect the two legs to the base through the corresponding L-shaped tunnel;

wherein a top part of each upper plate of each foldable leg has a front groove, and each back corner of the upper member has a corresponding back groove that matches the front groove, wherein the corresponding back grooves of the upper member enable to connect the upper member to the two legs by assembling the corresponding back grooves into the front grooves of the two foldable legs.

2. The stand of claim 1, wherein said pair of holes in said parallel lower plates are cross-shaped holes, and wherein said hinge comprises two pieces each of which has two parallel rods, wherein a combining together of the two pieces inside the cross-shaped holes comprises the hinge that enables the axial attachment of the parallel lower plates and the upper plate together.

3. The stand of claim I wherein an inner length of said drawer is equal to or greater than the a length of said upper member, and an inner width of the drawer is equal to or greater than a width of the upper member, and wherein the inner length of the drawer is equal to or greater than the a length of each foldable legs, and the inner width of the drawer is equal to or greater than a length of an upper side of each foldable legs together with a length of a bottom side of each foldable leg.

* * * * *